US007669325B2

(12) United States Patent
Husted et al.

(10) Patent No.: US 7,669,325 B2
(45) Date of Patent: Mar. 2, 2010

(54) METHOD OF ASSEMBLING A MODULAR PORTABLE COMPRESSOR

(75) Inventors: Dale E. Husted, Rolling Prairie, IN (US); James J. Papczynski, Laporte, IN (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1113 days.

(21) Appl. No.: 11/301,886

(22) Filed: Dec. 13, 2005

(65) Prior Publication Data

US 2007/0130765 A1 Jun. 14, 2007

(51) Int. Cl.
*B23P 15/00* (2006.01)
*F04B 53/00* (2006.01)

(52) U.S. Cl. ..... 29/888.02; 417/234; 417/360

(58) Field of Classification Search ..... 29/888.02, 29/464, 466, 469; 417/53, 234, 360, 238; 165/51; 137/899.4

See application file for complete search history.

(56) References Cited

U.S. PATENT DOCUMENTS

| | | | | | |
|---|---|---|---|---|---|
| 4,022,550 | A * | 5/1977 | Brink et al. | ..... | 417/234 |
| 4,547,131 | A * | 10/1985 | Riffe et al. | ..... | 417/53 |
| 4,572,474 | A * | 2/1986 | Derlich | ..... | 248/639 |
| 5,378,119 | A * | 1/1995 | Goertzen | ..... | 417/313 |
| 5,626,468 | A * | 5/1997 | Muir et al. | ..... | 417/360 |
| 6,231,315 | B1 * | 5/2001 | Ikeda et al. | ..... | 417/269 |
| 6,582,201 | B2 * | 6/2003 | Lucchi | ..... | 417/234 |
| 2002/0009372 | A1 * | 1/2002 | Gruber et al. | ..... | 417/234 |
| 2007/0134104 | A1 * | 6/2007 | Husted | ..... | 417/360 |

* cited by examiner

*Primary Examiner*—David P Bryant
*Assistant Examiner*—Ryan J Walters
(74) *Attorney, Agent, or Firm*—Stephen G. Mican

(57) ABSTRACT

A method of assembling a portable compressor package comprises steps of assembling a sub-frame module that comprises the mechanical components of an apparatus for ease of assembly to associated structural modules for minimisation of assembly time and ease of assembly.

24 Claims, 5 Drawing Sheets

METHOD OF ASSEMBLING A MODULAR PORTABLE COMPRESSOR

FIELD OF THE INVENTION

The invention relates to portable compressor equipment, and more particularly to assembly of portable compressor equipment with a modular design.

BACKGROUND OF THE INVENTION

Traditionally, portable compressors for compressing gas, such as air and natural gases, have a single integrated unit design. The various components for the compressor are mounted and assembled sequentially on a single chassis or frame. Because the compressor components mount onto the chassis or frame sequentially, it is impossible to assemble different portions of the compressor at the same time in order to reduce assembly time. Furthermore, mounting many components directly on the compressor chassis or frame is often difficult and physically challenging. Assembly in this manner may thereby cause unnecessary physical strain or injury to assemblers.

Although other industries have employed modular techniques to aid in assembly or servicing of equipment, such as the vehicular and industrial tool industries, such modular techniques have not addressed the modularisation of mechanical components of an apparatus for ease of assembly in combination with minimisation of assembly time.

SUMMARY OF THE INVENTION

The invention comprises a method of assembly for a portable compressor package that comprises steps of assembling a sub-frame module that comprises the mechanical components of an apparatus for ease of assembly to associated structural modules for minimisation of assembly time and ease of assembly. The invention also comprises alignment features and tooling for mating modules together during assembly.

Generally, the invention comprises a method of assembling a portable compressor assembly with machinery comprising at least a compressor driven by a prime mover, comprising the steps of: raising a sub-frame module comprising a chassis for mounting the machinery and a lifting bail by its lifting bail; moving a containment frame module for supporting, protecting and transporting the machinery mounted on the sub-frame module beneath the sub-frame module; dropping the sub-frame module toward the containment frame module; aligning the sub-frame module with the containment frame module; dropping the sub-frame module after alignment to engage the containment frame module; raising a canopy module for covering and protecting the machinery mounted on the sub-frame module over the sub-frame module; and dropping the canopy module to engage the containment frame module.

DETAILED DESCRIPTION OF THE INVENTION

Figure 1:
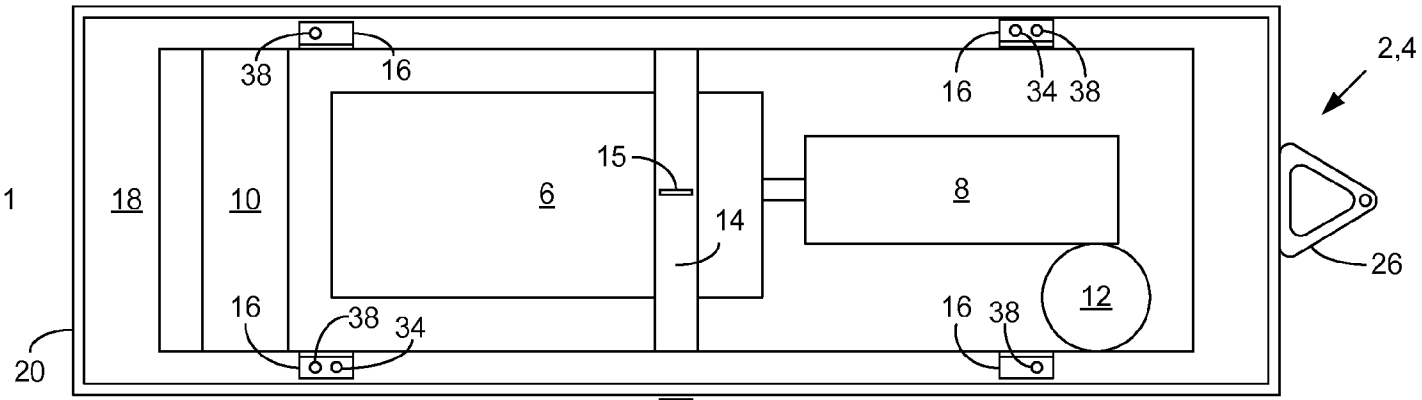
FIGS. 1 and 2 are top and side views, respectively, of a sub-frame module ready to mount to a containment frame module for a portable compressor according to a possible embodiment of the invention.
Figure 2:
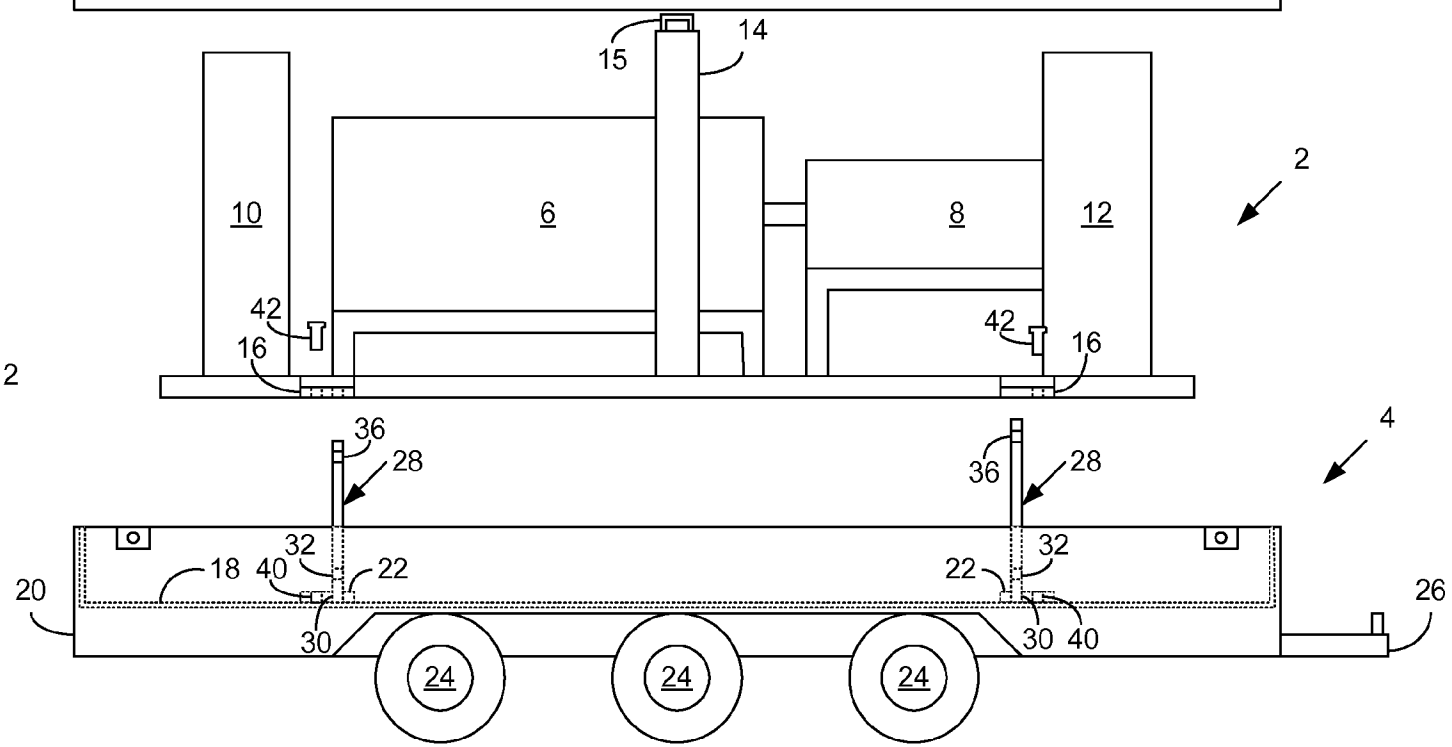

FIGS. 1 and 2 are top and side views, respectively, of a sub-frame module 2 ready to mount to a containment frame module 4 for a portable compressor according to a possible embodiment of the invention. The sub-frame module 2 preferably comprises a chassis for mounting most of the operating components for the compressor. These most commonly comprise a prime mover 6, typically a diesel engine, a compressor 8 coupled to the prime mover 6, an air cooling system 10, such as a cooler module, an accumulator 12, such as an air tank, and a lifting bail 14 with a lifting point, such as a lifting hook 15, that extends above the operating components. The sub-frame module 2 also mounts sundry components associated with the aforementioned components, such as batteries, hose lines, hydraulic tubing lines and so forth. Lastly, the sub-frame module 2 comprises a plurality of mounting pads or flanges 16 for mounting the sub-frame module 2 to the containment frame module 4.

It is convenient to mount the sub-frame module 2 on a movable platform, such as a scissor lift table, during assembly of the aforementioned components onto it. In this way, the position of the sub-frame module 2 is adjustable to any height desired to minimise physical strain whilst mounting the components.

The containment frame module 4 comprises a containment barrier or shield 18 and support frame 20 for supporting the sub-frame module 2. The containment shield 18 protects the ambient surroundings from any fluids, such as oil or fuel, that may drip from components mounted on the sub-frame module 2. The containment shield 18 also protects the components mounted on the sub-frame module 2 from exposure to the ambient surroundings underneath the containment frame module 4, such as flying rocks, splashing water and mud. The support frame 20 provides structural support for the sub-frame module 2.

The containment frame module 4 also comprises a plurality of mounting pads or flanges 22 that attach to the mounting flanges 16 on the sub-frame module 2 to hold the sub-frame module 2 in place once mounted. The containment frame module 4 may also comprise means for transporting the portable compressor, such as a plurality of wheel/axle assemblies 24 and a trailer hitch 26.

A plurality of assembly guides 28 assist mounting of the sub-frame module 2 to the containment frame module 4. The assembly guides 28 comprise generally cylindrical elements that mount in sockets or apertures 30 in the containment frame module 4.

Typically, the apertures 30 are located in selected ones of the mounting flanges 22, although they could be positioned otherwise, such as in various positions in the support frame 20. Preferably, two of the assembly guides 28 mount in apertures 30 that are located near opposite corners of the containment frame module 4. Preferably, the apertures 30 and insertion ends of the assembly guides 28 are threaded so that the assembly guides 28 screw into their mating apertures 30 for secure mounting. The apertures 30 may conveniently comprise threaded nuts fastened to their respective mounting flanges 22. Flats 32 along the assembly guides 28 near their insertion ends assist screwing them into the apertures 30.

The sub-frame module 2 has a plurality of apertures 34 for receiving the assembly guides 28 during mounting of the sub-frame module 2 onto the containment frame module 4. Typically, the apertures 34 are located in selected ones of the mounting flanges 16, although they could be positioned otherwise, such as in various other positions in the sub-frame module 20. In any case, the apertures 34 are aligned so that when they receive their mating assembly guides 28, the sub-frame module 2 is correctly aligned for mounting onto the containment frame module 4.

With the sub-frame module 2 positioned over the containment frame module 4, such as with a lifting crane (not shown) that attaches to the lifting point or hook 15 on the lifting bail 14, the sub-frame module 2 starts to drop onto the containment frame module 4. Preferably, one of the assembly guides 28 is longer so that a simple rotation of the sub-frame module 2 as it drops allows it to engage first with its corresponding aperture 34 in the sub-frame module 2, thus establishing initial alignment with the containment frame module 4. As the sub-frame module 2 continues to drop, a slight additional rotation of the sub-frame module 2 as needed allows another assembly guide 28 to engage with its corresponding aperture 34 in the sub-frame module 2. This establishes correct positioning of the sub-frame module 2 onto the containment frame module 4 as the sub-frame module 2 comes to rest in place on the containment frame module 4 and the mounting flanges 16 on the sub-frame module 2 engage their respective mounting flanges 22 on the containment frame module 4.

Figure 3:
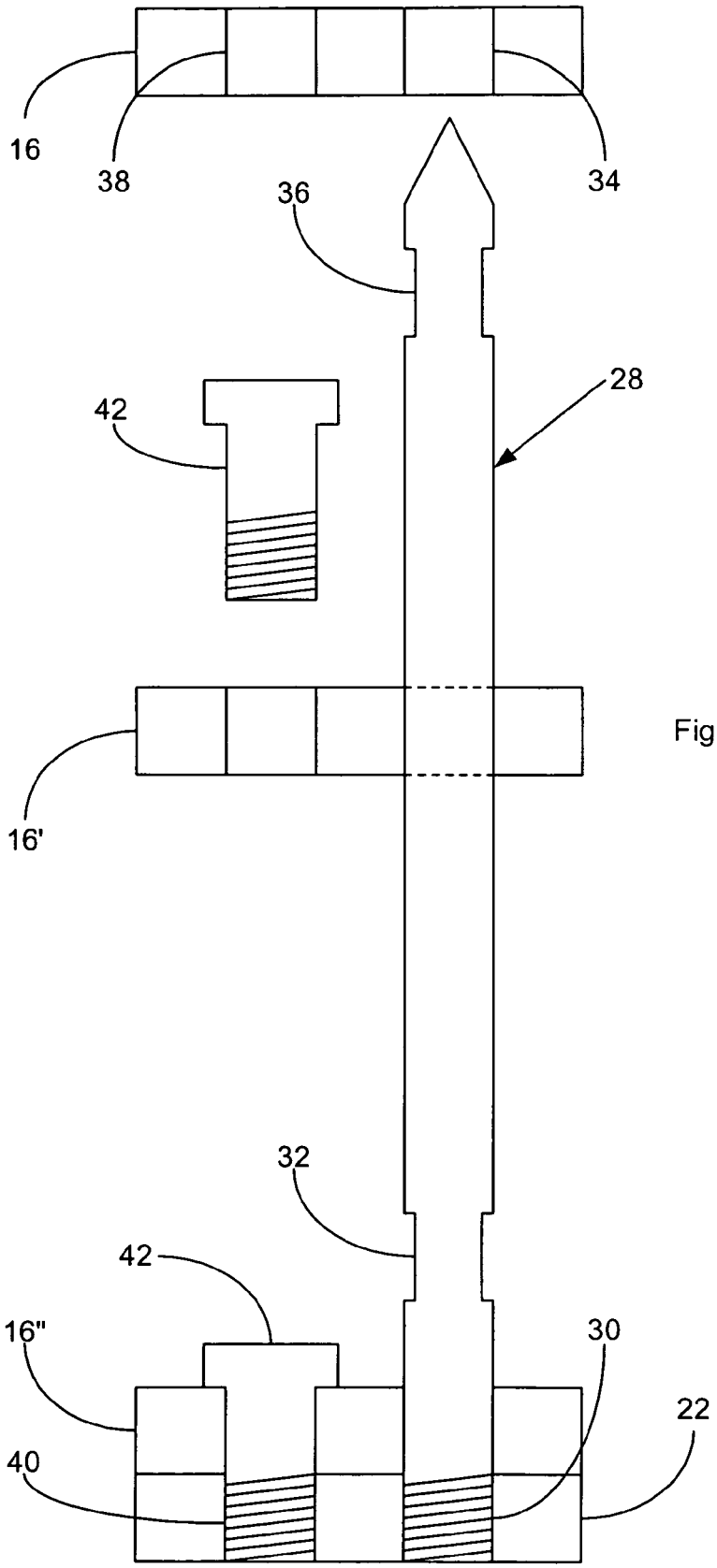
FIG. 3 is a detailed side view of one of a plurality of alignment guides according to the invention that is useful for aligning the sub-frame module with the containment frame module during assembly of the portable compressor.

Removal of the assembly guides 28 from their mating apertures 34 is possible after the sub-frame module 2 comes to rest on the containment frame module 4. FIG. 3 is a detailed side view of one of the alignment guides 28, the alignment guide 28' inserted into its mating mounting flange 22 on the containment frame 4, and its mating mounting flange 16 on the sub-frame module 2 shown before engagement with the alignment rod 28', after engagement with the alignment rod 28' and upon coming to rest on its respective mounting flange 22, as indicated by mounting flanges 16, 16' and 16", respectively.

Figure 4:
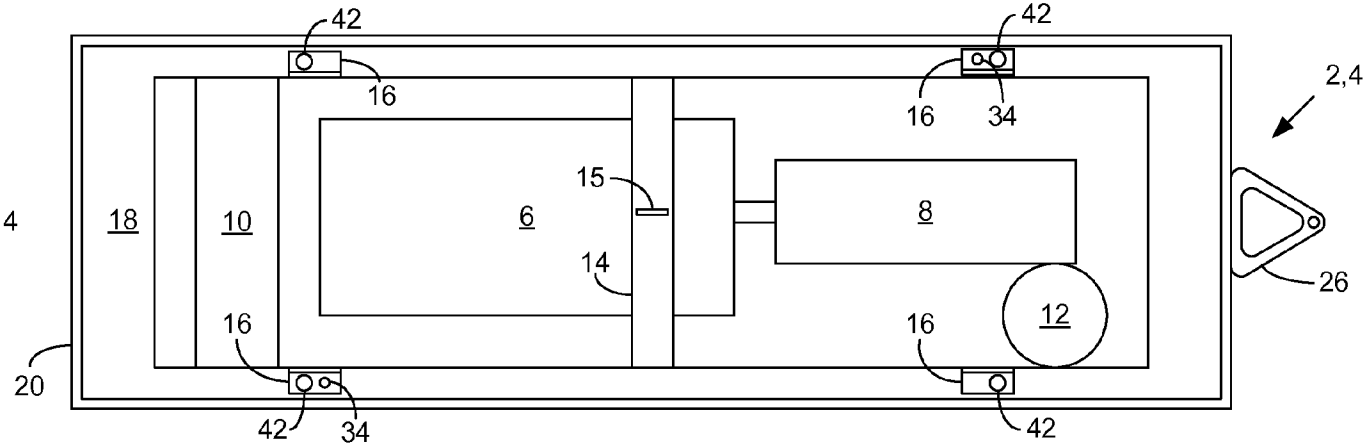
FIGS. 4 and 5 are top and side views, respectively, of a sub-frame module mounted to a containment frame module for a portable compressor according to a possible embodiment of the invention.
Figure 5:
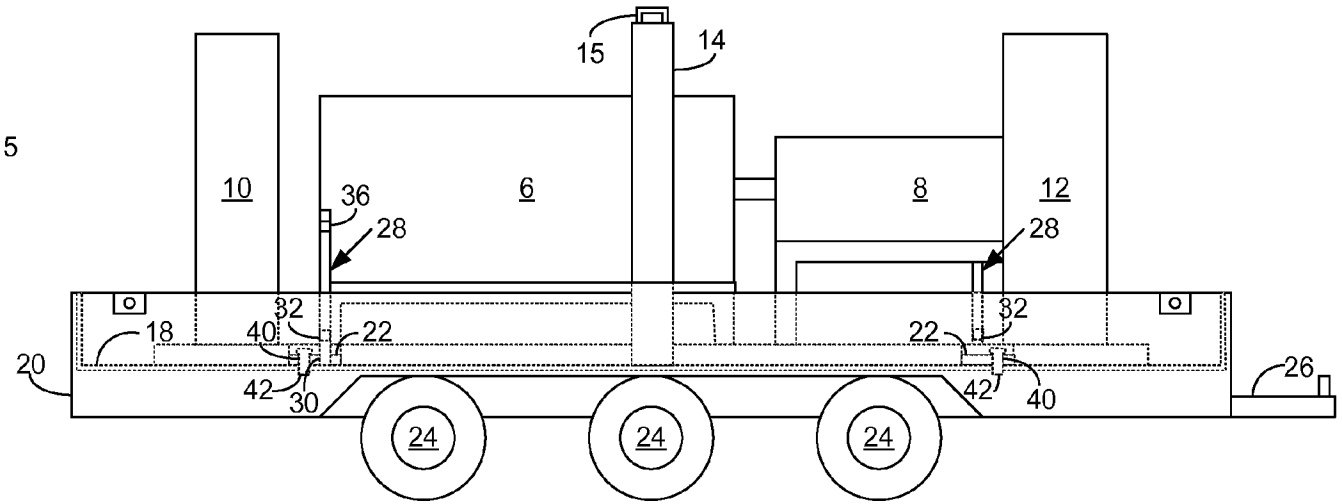

Flats 36 along the assembly guides 28 near their free ends assist screwing them out of the apertures 30. The mounting flanges 16 and 22 have mating attachment points that may comprise additional apertures 38 and 40 or the apertures 30 and 34 themselves. Suitable fasteners 42 clamp the sub-frame module 2 to the containment frame module 4 to form a rigid assembly as shown in FIGS. 4 and 5. It is convenient for the fasteners 42 to comprise threaded bolts and their mating apertures 40 to comprise mating threaded nuts that are fastened to their respective mounting flanges 22.

Figure 6:
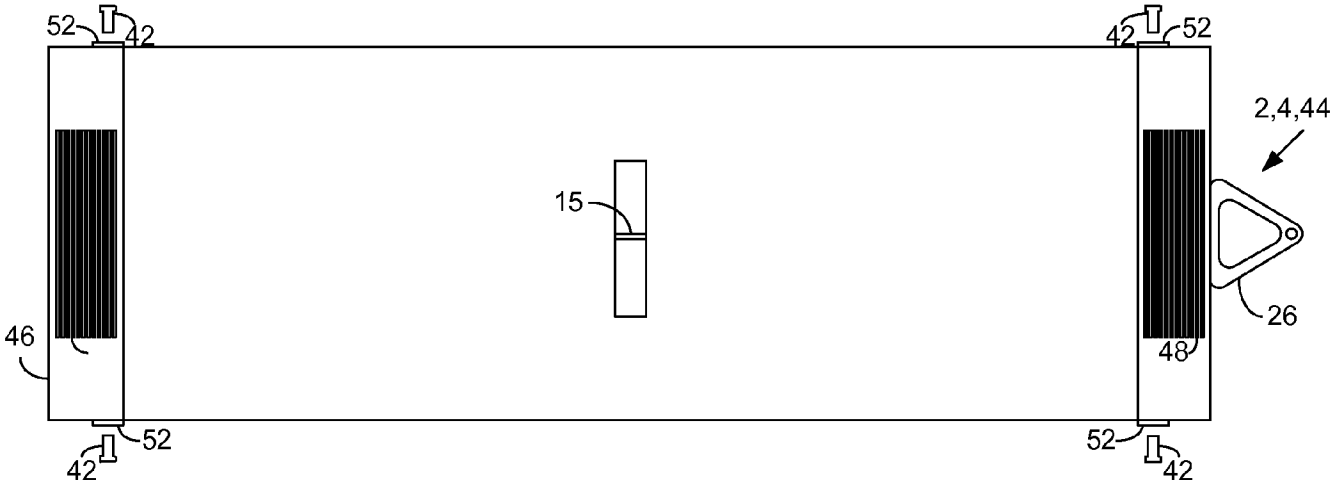
FIGS. 6 and 7 are top and side views, respectively, of a canopy module ready to mount to a sub-frame module and a containment frame module for a portable compressor according to a possible embodiment of the invention.
Figure 7:
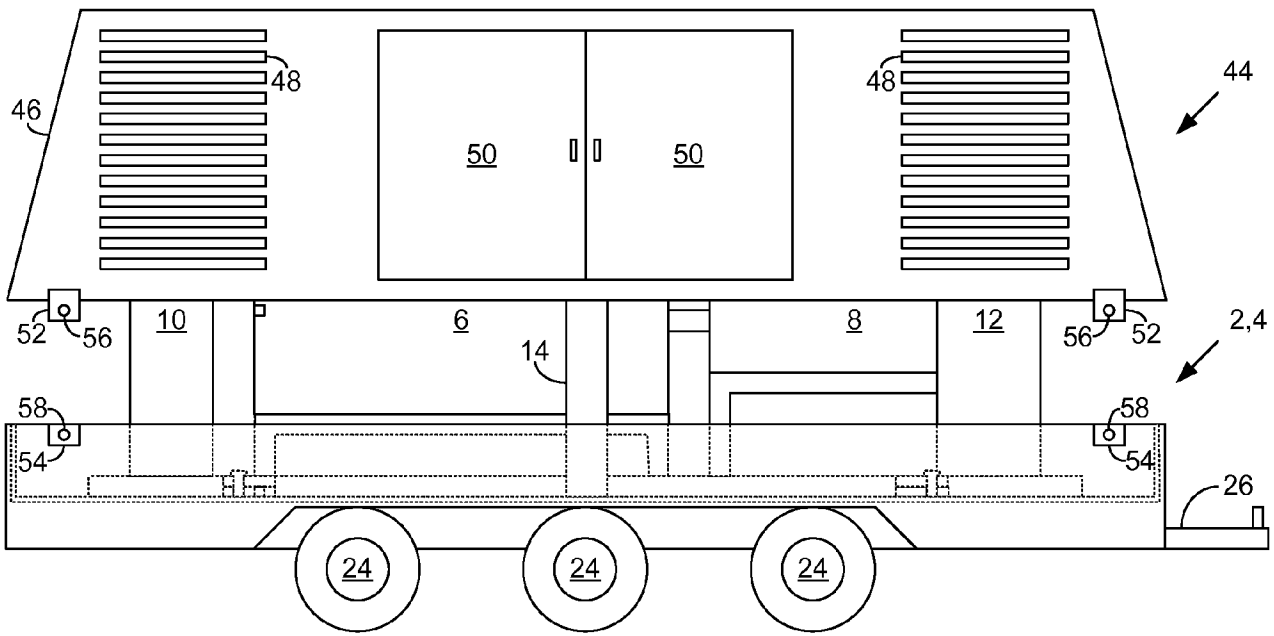

FIGS. 6 and 7 are top and side views, respectively, of a canopy module 44 ready to mount to the mounted sub-frame module 2 and the containment frame module 4 as shown in FIGS. 4 and 5. The canopy module 44 comprises a cover 46 that typically comprises a plurality of louvers 48 for ventilation and a plurality of access doors 50 for maintenance and servicing of the aforementioned components mounted to the sub-frame module 2. The canopy module 44 also comprises a plurality of mounting pads or flanges 52 that attach to a plurality of mounting pads or flanges 54 on the containment frame module 4 to mount the canopy module 44 over the sub-frame module 2 to the containment frame module 4.

Figure 8:
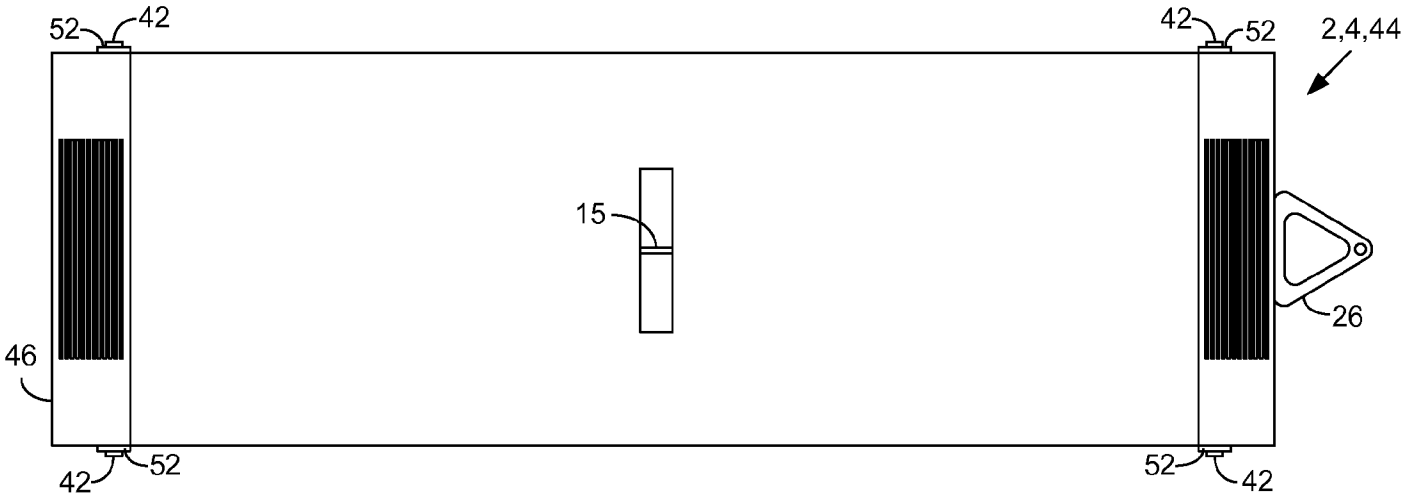
FIGS. 8 and 9 are top and side views, respectively, of a canopy module mounted to a sub-frame module and a containment frame module for a portable compressor according to a possible embodiment of the invention.
Figure 9:
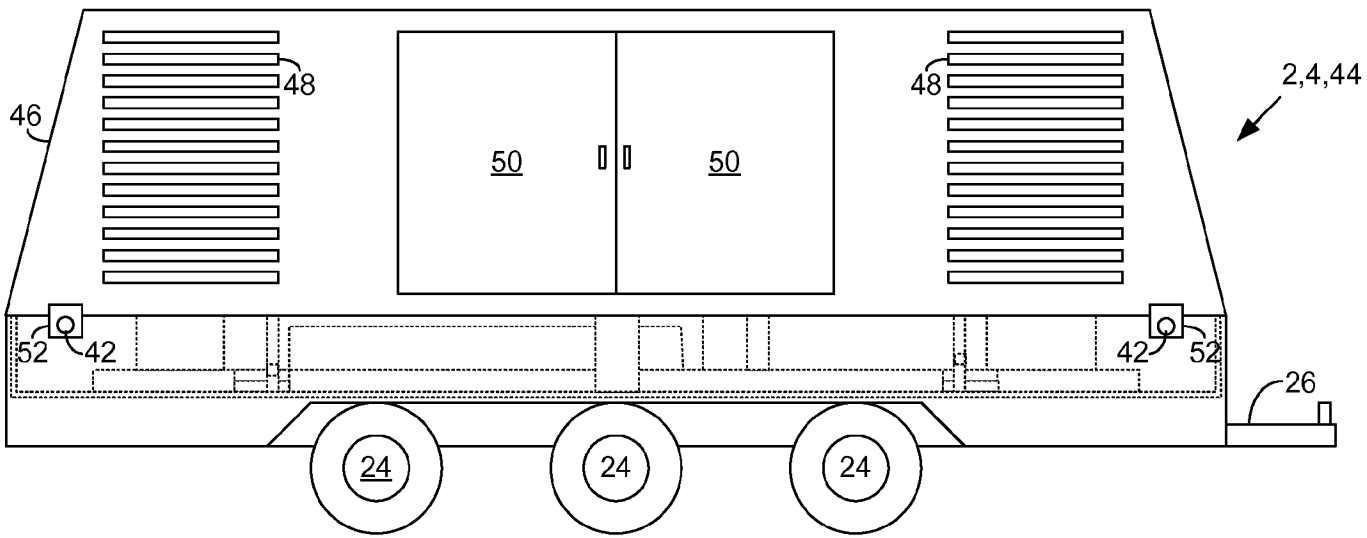

The mounting flanges 52 and 54 have mating attachment points that may comprise apertures 56 and 58 respectively. Suitable fasteners 42 clamp the canopy module 44 to the containment frame module 4 to form the complete portable compressor assembly as shown in FIGS. 8 and 9. It is convenient for the fasteners 42 to comprise threaded bolts and their mating apertures 58 to comprise mating threaded nuts that are fastened to their respective mounting flanges 54.

Described above is a method of assembling a portable compressor package that comprises steps of assembling a sub-frame module that comprises the mechanical components of an apparatus for ease of assembly to associated structural modules for minimisation of assembly time and ease of assembly. The described embodiment of the invention is only an illustrative implementation of the invention wherein changes and substitutions of the various parts and arrangement thereof are within the scope of the invention as set forth in the attached claims.

What is claimed is:

1. A method of assembling a portable compressor assembly with machinery comprising at least a compressor driven by a prime mover, comprising the steps of:

mounting the machinery on a sub-frame module comprising a chassis for receiving the machinery and a lifting bail to position a lifting point of the sub frame module above the machinery;

raising the sub-frame module by the lifting bail at its lifting point;

moving beneath the sub-frame module a containment frame module for supporting, protecting and transporting the machinery mounted on the sub-frame module;

dropping the sub-frame module toward the containment frame module;

aligning the sub-frame module with the containment frame module;

dropping the sub-frame module after alignment to engage the containment frame module;

raising over the sub-frame module a canopy module for covering and protecting the machinery mounted on the sub-frame module; and dropping the canopy module to engage the containment frame module.

2. The method of claim 1, wherein the step of dropping the sub-frame module to engage the containment frame module further comprises the step of engaging a plurality of mounting flanges on the sub-frame module with a plurality of respective mounting flanges on the containment frame module.

3. The method of claim 2, wherein the step of aligning the sub-frame module further comprises the steps of:

inserting generally cylindrical alignment guides into mating apertures in at least two of the containment frame module mounting flanges; and aligning mating apertures in respective ones of the mounting flanges on the sub-frame module with the alignment guides.

4. The method of claim 3, wherein one of the alignment guides is longer, further comprising the steps of:

rotating the sub-frame module to align the longer alignment guide with its mating aperture in a respective one of the mounting flanges on the sub-frame module;

dropping the sub-frame module toward the containment frame module to engage the longer alignment guide in its mating aperture;

rotating the sub-frame module to align any remaining alignment rod with its mating aperture in a respective one of the mounting flanges on the sub-frame module; and dropping the sub-frame module toward the containment frame module to engage any such remaining alignment guide in its mating aperture.

5. The method of claim 4, wherein two alignment guides insert in mating apertures that are located near opposite corners of the containment frame module.

6. The method of claim 3, further comprising the step of screwing alignment guides with threaded insertion ends into mating threaded apertures.

7. The method of claim 6, wherein flats in the alignment guides near their threaded insertion ends assist the step of screwing the alignment guides into their mating threaded apertures.

8. The method of claim 6, wherein the threaded insertion ends of the alignment guides screw into threaded nuts fastened to the mounting flanges on the containment frame module.

9. The method of claim 2, wherein the step of dropping the sub-frame module to engage the containment frame module further comprises the step of fastening at least some of the mounting flanges on the sub-frame module to respective ones of the mounting flanges on the containment frame module.

10. The method of claim 9, wherein the step of fastening comprises inserting threaded bolts through mating apertures in the mounting flanges for the sub-frame module to engage mating threaded apertures in the mounting flanges for the containment frame module.

11. The method of claim 1, wherein the step of dropping the canopy module to engage the containment frame module further comprises the step of engaging a plurality of mounting flanges on the canopy module with a plurality of respective mounting flanges on the containment frame module.

12. The method of claim 11, wherein the step of dropping the canopy module to engage the containment frame module further comprises the step of fastening at least some of the mounting flanges on the canopy module to respective ones of the mounting flanges on the containment frame module.

13. The method of claim 12, wherein the step of fastening comprises inserting threaded bolts through mating apertures in the mounting flanges for the canopy module to engage mating threaded apertures in the mounting flanges for the containment frame module.

14. A method of assembling a portable compressor assembly with machinery comprising at least a compressor driven by a prime mover, comprising the steps of:

mounting the machinery on a sub-frame module comprising a chassis for receiving the machinery, a plurality of mounting flanges and a lifting bail to position a lifting point of the sub frame module above the machinery mounting a plurality of mounting flanges on the sub-frame module;

raising the sub-frame module by the lifting bail;

moving beneath the sub-frame module a containment frame module comprising a containment shield for protecting the machinery mounted on the sub-frame module, a support frame for supporting and transporting the machinery mounted on the sub-frame module and a plurality of mounting flanges;

dropping the sub-frame module toward the containment frame module;

inserting generally cylindrical alignment guides into mating apertures in at least two containment frame module mounting flanges; and aligning mating apertures in respective ones of the mounting flanges on the sub-frame module with the alignment guides;

dropping the sub-frame module after alignment to engage at least some of the mounting flanges on the sub-frame module to with respective ones of the mounting flanges containment frame module;

raising over the sub-frame module a canopy module for covering and protecting the machinery mounted on the sub-frame module comprising a plurality of ventilation louvers, access doors and a plurality of mounting flanges; and dropping the canopy module to engage at least some of the mounting flanges on the canopy module with respective ones of the mounting flanges on the containment frame module.

15. The method of claim 14, wherein one of the alignment guides is longer, further comprising the steps of:

rotating the sub-frame module to align the longer alignment guide with its mating aperture in a respective one of the mounting flanges on the sub-frame module;

dropping the sub-frame module toward the containment frame module to engage the longer alignment guide in its mating aperture;

rotating the sub-frame module to align any remaining alignment rod with its mating aperture in a respective one of the mounting flanges on the sub-frame module; and dropping the sub-frame module toward the containment frame module to engage any such remaining alignment guide in its mating aperture.

16. The method of claim 15, wherein two alignment guides insert in mating apertures that are located near opposite corners of the containment frame module.

17. The method of claim 15, further comprising the step of screwing alignment guides with threaded insertion ends into mating threaded apertures.

18. The method of claim 17, wherein flats in the alignment guides near their threaded insertion ends assist the step of screwing the alignment guides into their mating threaded apertures.

19. The method of claim 17, wherein the threaded insertion ends of the alignment guides screw into threaded nuts fastened to the mounting flanges on the containment frame module.

20. The method of claim 15, wherein the step of dropping the sub-frame module to engage the containment frame module further comprises the step of fastening at least some of the mounting flanges on the sub-frame module to respective ones of the mounting flanges on the containment frame module.

21. The method of claim 20, wherein the step of fastening comprises inserting threaded bolts through mating apertures in the mounting flanges for the sub-frame module to engage mating threaded apertures in the mounting flanges for the containment frame module.

22. The method of claim 15, wherein the step of dropping the canopy module to engage the containment frame module further comprises the step of engaging a plurality of mounting flanges on the canopy module with a plurality of respective mounting flanges on the containment frame module.

23. The method of claim 22, wherein the step of dropping the canopy module to engage the containment frame module further comprises the step of fastening at least some of the mounting flanges on the canopy module to respective ones of the mounting flanges on the containment frame module.

24. The method of claim 23, wherein the step of fastening comprises inserting threaded bolts through mating apertures in the mounting flanges for the canopy module to engage mating threaded apertures in the mounting flanges for the containment frame module.

* * * * *